US005174256A

United States Patent [19]

Binford

[11] Patent Number: 5,174,256

[45] Date of Patent: Dec. 29, 1992

[54] VARIABLE GUIDE HEIGHT VALVE SEAL

[75] Inventor: John D. Binford, Richmond, Ind.

[73] Assignee: Dana Corporation, Toledo, Ohio

[21] Appl. No.: 797,708

[22] Filed: Nov. 25, 1991

[51] Int. Cl.[5] ..... F01L 3/08

[52] U.S. Cl. ..... 123/188.6; 123/188.9

[58] Field of Search ..... 123/188 P, 188 GC, 188 SA, 123/90.66; 277/153, 152, 177, 178, 175

[56] References Cited

U.S. PATENT DOCUMENTS

| | | | |
|---|---|---|---|
| 2,117,434 | 5/1938 | Krebs | 123/90.66 |
| 3,498,621 | 3/1970 | Wilson | 277/152 |
| 3,699,942 | 10/1972 | Moray | 123/188 P |
| 4,124,220 | 11/1978 | Leone et al. | 123/188 P |
| 4,317,436 | 3/1982 | Barnhardt et al. | 123/188 P |
| 4,368,699 | 1/1983 | Kodama | 123/90.67 |
| 4,509,473 | 4/1985 | Hamparian | 123/188 SC |
| 4,531,483 | 7/1985 | Vossieck et al. | 123/188 P |
| 4,773,363 | 9/1985 | Stritzke | 123/188 P |
| 4,811,960 | 3/1989 | Stritzke et al. | 277/153 |
| 4,826,180 | 5/1989 | Deuring | 123/188 P |
| 4,909,202 | 3/1990 | Binford et al. | 123/188 P |
| 4,947,811 | 8/1990 | Binford | 277/178 |

*Primary Examiner*—E. Rollins Cross
*Assistant Examiner*—Erick Solis
*Attorney, Agent, or Firm*—Frank B. McDonald; Robert M. Leonardi; Barbara Joan Haushalter

[57] ABSTRACT

A valve stem seal assembly adapted for a reciprocable valve stem disposed within a valve guide can tolerate major variations in the guide height. The assembly includes a lower hollow cylindrical shell and an upper hollow cylindrical shell, both disposed about the valve guide. The upper hollow cylindrical shell is capable of being telescopically received within the lower hollow cylindrical shell in a slip-fit relationship. A seal member is secured to the upper hollow cylindrical shell, the seal member extending radially inwardly so as to engage the reciprocable valve stem and extending axially downwardly so as to engage the valve guide.

6 Claims, 1 Drawing Sheet

VARIABLE GUIDE HEIGHT VALVE SEAL

BACKGROUND OF THE INVENTION

The present invention relates to valve seals for internal combustion engines and, more particularly, to an improved structure for a valve stem seal assembly.

Internal combustion engines have a plurality of intake and exhaust valves, each comprising a valve head and a stem reciprocally mounted in a valve guide. The guide height is often imprecise, since precise tolerances would require special machining which increases the cost of the engine. However, inadequate sealing caused by tolerance variations may result in excessive oil consumption. Since the valve stem ordinarily operates in a substantial volume of oil, efforts have been directed toward a decrease in the amount of oil consumed by the engine.

In order to reduce oil consumption and exhaust emissions, and to prevent carbon build-up valve seals have been mounted on valve guides and about valve stems to meter the amount of oil flowing between the stem and the guide. Since valve seal durability is dictated by the choice of sealing rubber, premium fluoroelastomer, which has exceptional physical properties, is often the material of choice for sealing elements. However, fluoroelastomer is very expensive, making rubber the major cost in valve stem seals.

It is seen then that there exists a need for an improved valve stem seal assembly which minimizes the use of rubber and which is capable of being adjusted for imprecise guide height tolerances.

SUMMARY OF THE INVENTION

This need is met by the valve stem seal assembly of the present invention which can accommodate major variations in guide height, eliminating the requirement for a precise guide height. In accordance with one aspect of the present invention, a valve stem seal assembly is used in an internal combustion engine. The assembly comprises a reciprocable valve stem and a valve guide for guiding the reciprocable valve stem. A lower hollow cylindrical shell and an upper hollow cylindrical shell are disposed about the valve guide. The upper hollow cylindrical shell is capable of being telescopically received within the lower hollow cylindrical shell in a friction slip-fit relationship. Finally, a seal member is secured to the upper hollow cylindrical shell such that the seal member extends radially inwardly to engage the reciprocable valve stem and extends axially downwardly to engage the top of the valve guide. The seal member is flexible enough to compress as the slip-fit is adjusted during installation.

The slip-fit arrangement between the upper and lower cylindrical shells allows the valve stem seal assembly of the present invention to be adjusted for imprecise and varying guide heights, while still tending to have the seal member collapse into an annular ring at the top of the guide to achieve an effective seal. This design provides the advantage of accommodating major variations in guide height tolerances, eliminating custom designing, tooling costs, and special machining.

Other advantages and features of the invention will be apparent from the following description, the accompanying drawings and the appended claims.

DETAILED DESCRIPTION OF THE PREFERRED EMBODIMENTS

Figure 1:
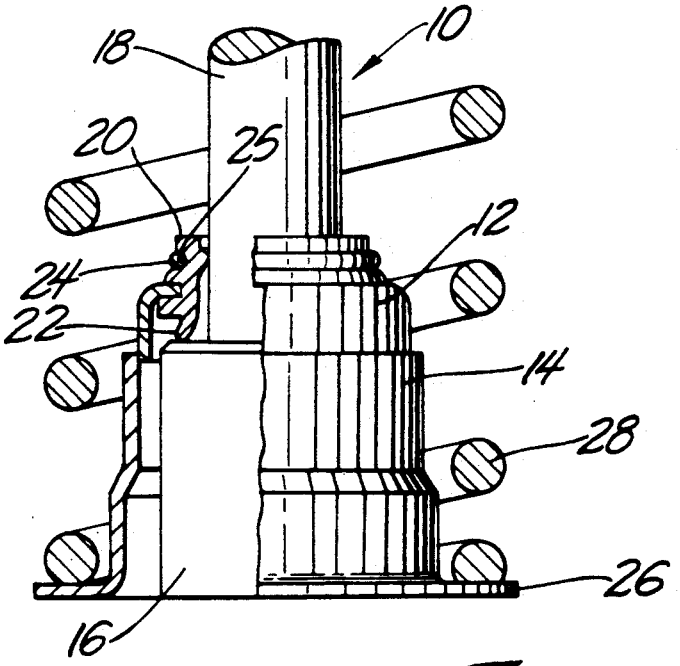
FIG. 1 is a view of a preferred embodiment of a valve stem seal assembly constructed in accordance with the present invention, with cut away portions.
Figure 2:
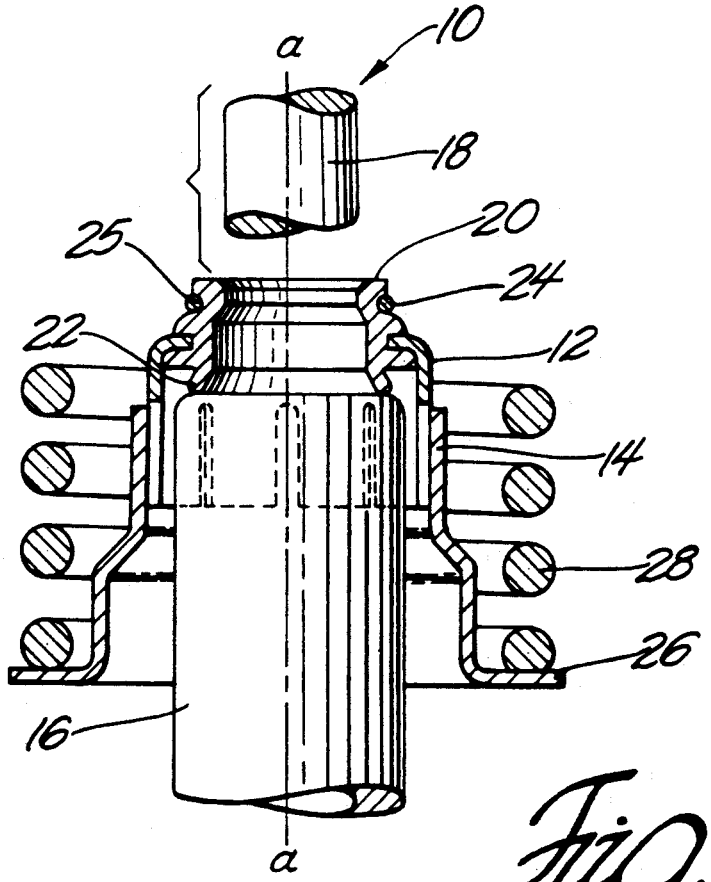
FIG. 2 is a cross-sectional view of the preferred embodiment of the valve stem seal assembly of FIG. 1.

Referring to the drawings, in FIGS. 1 and 2 there is illustrated a valve stem seal assembly 10 which can tolerate major variations in guide height. The assembly 10 includes upper and lower hollow cylindrical shells 12 and 14, respectively, each having a longitudinal axis "a—a". The shells 12 and 14 are disposed about a valve guide 16 and a valve stem 18.

As best illustrated in FIG. 2, the upper hollow cylindrical shell 12 is capable of being telescopically received within the lower hollow cylindrical shell 14. In a preferred embodiment of the present invention, the shell 12 is received within the shell 14 in a friction slip-fit relationship. However, any technique which would allow the two shells 12 and 14 to move, one with respect to the other, and provide proper and permanent compression of a seal member 20 against the top of the guide 16 may be employed.

The resilient elastomer seal member 20 is secured to the top of the upper cylindrical shell 12 to sealingly engage the valve stem 18 and the top of the valve guide 16 in order to control oil consumption associated with the reciprocal movement of the stem 18 in the valve guide 16, as will be appreciated by those skilled in the art. The seal member 20 extends radially inwardly so as to engage the valve stem 18, and axially downwardly so as to engage the top of the valve guide 16. Since the seal member 20 provides a seal at the top of the guide 16, it is unnecessary to provide additional sealing outside of the guide 16. This minimizes the amount of rubber or fluoroelastomer used for the valve stem seal assembly 10, thereby minimizing the cost of manufacturing the assembly 10.

Continuing with the drawings, a spring 24, supported in an exterior groove 25 of the resilient seal member 20, is used to provide a compressive force between the seal member 20 and the valve stem 18. The lower cylindrical shell 14 may be formed to provide a seat 26 for a valve coil spring 28. The seat 26 extends radially with respect to the valve guide 16 and is integral with the lower hollow cylindrical shell 14. It will be apparent to those skilled in the art that the valve stem seal assembly 10 of the present invention may also be used in applications where a spring seat is not required. The top of the spring is adapted to engage a spring retainer connected to an intake or exhaust valve (neither shown).

The upper and lower shells 12 and 14 are manufactured separately, and then assembled in a permanent friction slip-fit relationship. The two shells 12 and 14 slide, one within the other, and automatically adjust, during installation, to the presented guide height. Although the seal member 20 is capable of compressing as the shells 12 and 14 are stretched for varying guide heights, the friction slip-fit relationship exists between the two shells 12 and 14. The amount of friction may be varied to allow the seal member 20 to compress in the manner in which it is designed to compress at the top of the guide 16, without damaging the seal member 20.

In a preferred embodiment of the present invention, as illustrated in FIGS. 1 and 2, the seal member 20 includes a lower lip 22 which engages the top of the valve guide 16. Additionally, the seal member 20 is secured to the top of the upper shell 12, with the lip 22 disposed between the top of the upper shell 12 and the top of the valve guide 16. Hence, the friction slip-fit arrangement between the upper and lower cylindrical shells 12 and 14 allows the seal member 20, when the seal member 20 is installed, to be compressed to accommodate imprecise and varying guide heights of guide 16, while still tending to have the lip 22 collapse into an annular ring at the top of the guide 16 to achieve an effective seal.

To achieve the friction slip-fit arrangement of the preferred embodiment of the present invention, the upper hollow cylindrical shell 12 may be any suitable material, including metal or plastic, which can slip or telescope inside the lower hollow cylindrical shell 14. The lower shell 14 is preferably a hard material, such as metal, which can support the valve coil spring 28 at the surface of seat 26. As mentioned previously, the actual slip-fit can be effected by any of a variety of techniques as long as the slip force is appropriate to neither over-compress nor under-compress the seal member 20. In a friction slip-fit, the upper hollow cylindrical shell 12 is frictionally engaged within the lower hollow cylindrical shell 14. The lower lip 22 of the seal member 20 flexes as the upper hollow cylindrical shell 12 is adjusted within the lower hollow cylindrical shell 14, to assure that a proper sealing of the lip 22 on top of the guide 16 is effected during installation.

The ability to have the valve stem seal assembly be adjusted for major variations in guide height of the guide 16 is important, since engine manufacturing techniques do not allow for easy control of the guide height. The friction slip-fit technique of the valve stem seal assembly 10 of the present invention allows for sufficient adjustment to accommodate guide heights of major variations.

It will be understood by those skilled in the art that other sealing designs and configurations, other than that illustrated in FIGS. 1 and 2, may be employed. For example, the sealing design may be of a multiple lip design, rather than the single lip design illustrated herein. The concept of the slip-fit arrangement between the upper hollow cylindrical shell 12 and the lower hollow cylindrical shell 14 may be applied to a variety of integral designs, without requiring specially designed components for each application. Finally, the flexible design of the valve stem seal assembly 10 may be adapted to a variety of different engines.

Although only one preferred embodiment has been shown and described herein, the following claims envision numerous additional embodiments which will fall within the spirit and scope thereof.

What is claimed is:

1. A valve stem seal assembly for use in an internal combustion engine, comprising:

a reciprocable valve stem;

a valve guide for guiding said reciprocable valve stem, said valve guide having a height measurement;

a lower hollow cylindrical shell disposed about said valve guide;

an upper hollow cylindrical shell disposed about said valve guide, said upper hollow cylindrical shell capable of being telescopically and permanently received within said lower hollow cylindrical shell in a slip-fit relationship for adjustment to said height measurement of said valve guide, the uppermost portion of said upper hollow cylindrical shell being located at a point higher than the uppermost portion of said lower hollow cylindrical shell; and a flexible seal member secured to said upper hollow cylindrical shell for providing an effective seal between said reciprocable valve stem and said valve guide, said flexible seal member having an exterior groove extending circumferentially about said flexible seal member and a spring contained within said exterior groove.

2. A valve stem seal assembly as claimed in claim 1 wherein said seal member extends radially inwardly so as to engage said reciprocable valve stem and extends axially downwardly so as to engage said valve guide.

3. A valve stem seal assembly as claimed in claim 1 wherein said seal member is capable of compressing as said upper hollow cylindrical shell telescopes within said lower hollow cylindrical shell in said slip-fit relationship.

4. A valve stem seal assembly as claimed in claim 1 wherein said seal member comprises at least one flexible annular lip for compressing against said valve guide to provide an effective seal between said reciprocable valve stem and said valve guide.

5. A valve stem seal assembly as claimed in claim 1 wherein said lower hollow cylindrical shell is formed to provide a seat for a valve spring.

6. A valve stem seal assembly as claimed in claim 1 wherein said slip-fit relationship is a friction slip-fit relationship.

* * * * *